US006701537B1

(12) United States Patent
Stamp

(10) Patent No.: US 6,701,537 B1
(45) Date of Patent: Mar. 9, 2004

(54) HEATED VISOR SYSTEM

(76) Inventor: Jamie J. Stamp, 471 Trillium St General Delivery, Victoria Harbor, ONT (CA), L0K 2A0

( * ) Notice: Subject to any disclaimer, the term of this patent is extended or adjusted under 35 U.S.C. 154(b) by 0 days.

(21) Appl. No.: 10/185,689

(22) Filed: Jun. 28, 2002

(51) Int. Cl.[7] ..... A42B 1/08; H05B 1/00
(52) U.S. Cl. ..... 2/424; 2/435; 219/211
(58) Field of Search ..... 2/424, 10, 9, 434, 2/435, 439, 425; 219/203, 211

(56) References Cited

U.S. PATENT DOCUMENTS 4,150,443 A * 4/1979 Mc Neilly
4,584,721 A * 4/1986 Yamamoto
4,682,007 A * 7/1987 Hollander
4,868,929 A * 9/1989 Curcio
D351,685 S * 10/1994 Kamata
5,471,036 A * 11/1995 Sperbeck ..... 2/435
5,500,953 A * 3/1996 Reuber et al.
5,561,855 A * 10/1996 McFall ..... 2/8
5,570,946 A * 11/1996 Chien ..... 362/84
5,683,831 A * 11/1997 Baril et al. ..... 429/96
5,822,126 A * 10/1998 Cursolle et al. ..... 359/630
5,896,579 A * 4/1999 Johnson et al. ..... 2/8
6,417,491 B1 * 7/2002 Taniuchi ..... 219/211
6,448,742 B1 * 9/2002 Waterman et al. ..... 320/114

FOREIGN PATENT DOCUMENTS

DE 3229021 A1 * 2/1984 ..... A42B/3/02

* cited by examiner

*Primary Examiner*—Rodney M. Lindsey

(57) ABSTRACT

A heated visor system for providing a user with a visor that will not fog up when used in cold weather. The heated visor system includes a helmet that has an opening. A visor is coupled to the helmet for covering the opening. A heating element is coupled to an interior face of the visor for heating the visor to prevent fogging of the visor during use of the helmet in cold weather. A power source is for the heating element. The power source is coupled to the visor whereby the visor, heating element, and power source are removable from the helmet.

6 Claims, 5 Drawing Sheets

HEATED VISOR SYSTEM

BACKGROUND OF THE INVENTION

1. Field of the Invention

The present invention relates to heated visor systems and more particularly pertains to a new heated visor system for providing a user with a visor that will not fog up when used in cold weather.

2. Description of the Prior Art

The use of heated visor systems is known in the prior art. U.S. Pat. No. 5,500,953 describes a device having a transparent visor that has a heating mechanism for eliminating the buildup of ice, condensation and fog. Another type of heated visor system is U.S. Pat. No. 4,868,929 describes electrically heated ski goggles. U.S. Pat. No. 4,682,007 describes defogging and deicing shield structure. U.S. Pat. No. 4,150,444 describes an anti-fogging sports goggle. U.S. Pat. No. 4,584,721 describes a device for use in helmet for preventing fogging by electric heating. U.S. Pat. No. Des. 351,685 describes an ornamental design for a helmet.

While these devices fulfill their respective, particular objectives and requirements, the need remains for a system that includes a heated visor system that can be sold with a helmet or attached to an existing helmet that has a cordless heating system that also provides balance to the helmet for reducing neck strain.

SUMMARY OF THE INVENTION

Another object of the present invention is to provide a new heated visor system that would be cordless to prevent the user from being bothered by a power cord extended between the visor and the machine.

Still another object of the present invention is to provide a new heated visor system that has power sources positioned on each side of the visor to maintain balance in the helmet to prevent neck strain.

To this end, the present invention generally comprises a helmet that has an opening. A visor is coupled to the helmet for covering the opening. A heating element is coupled to an interior face of the visor for heating the visor to prevent fogging of the visor during use of the helmet in cold weather. A power source is for the heating element. The power source is coupled to the visor whereby the visor, heating element, and power source are removable from the helmet.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
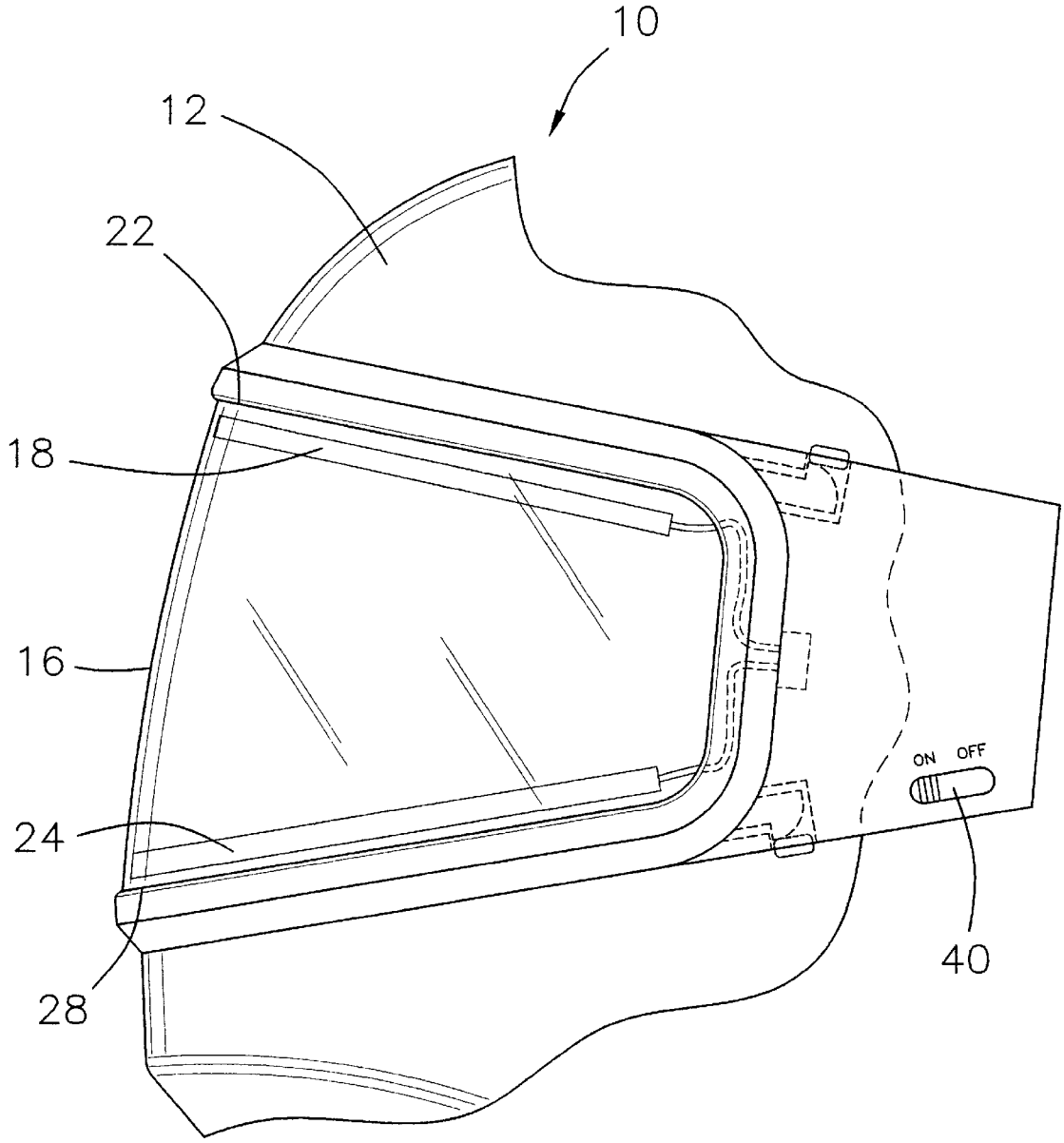
FIG. 1 is a side view of a new heated visor system according to the present invention.
Figure 2:
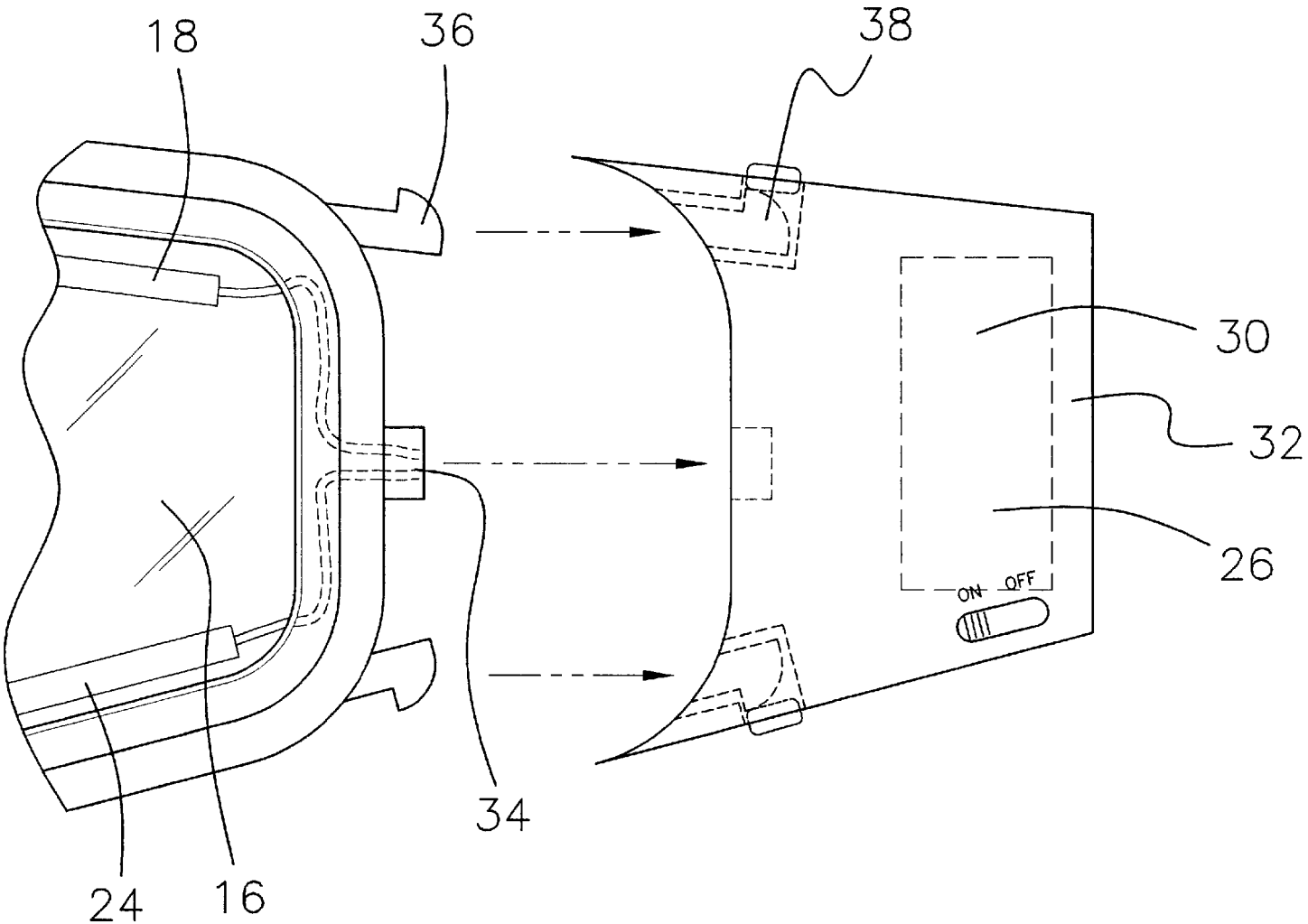
FIG. 2 is an expanded view of the present invention.
Figure 3:
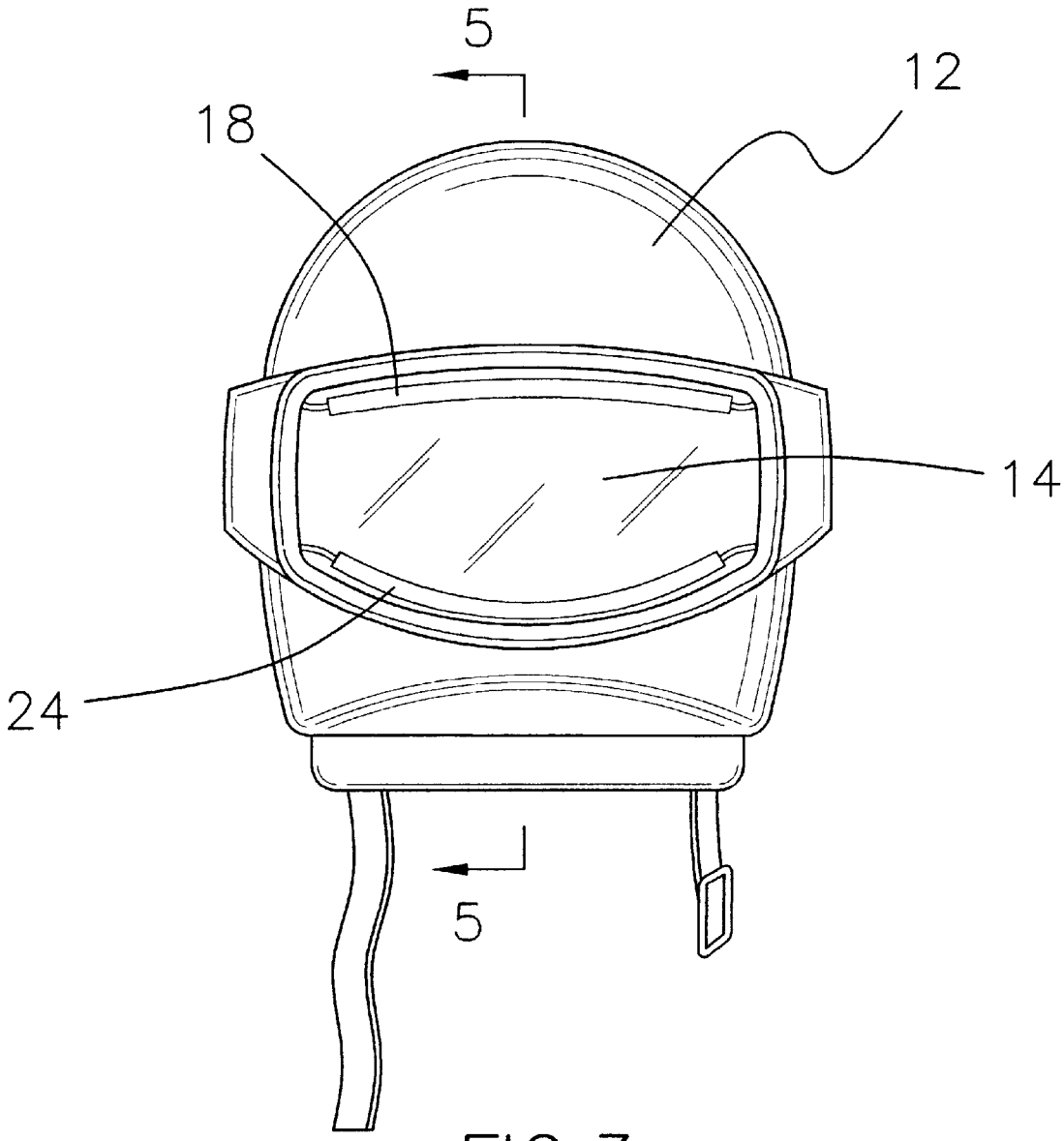
FIG. 3 is a front view of the present invention.
Figure 4:
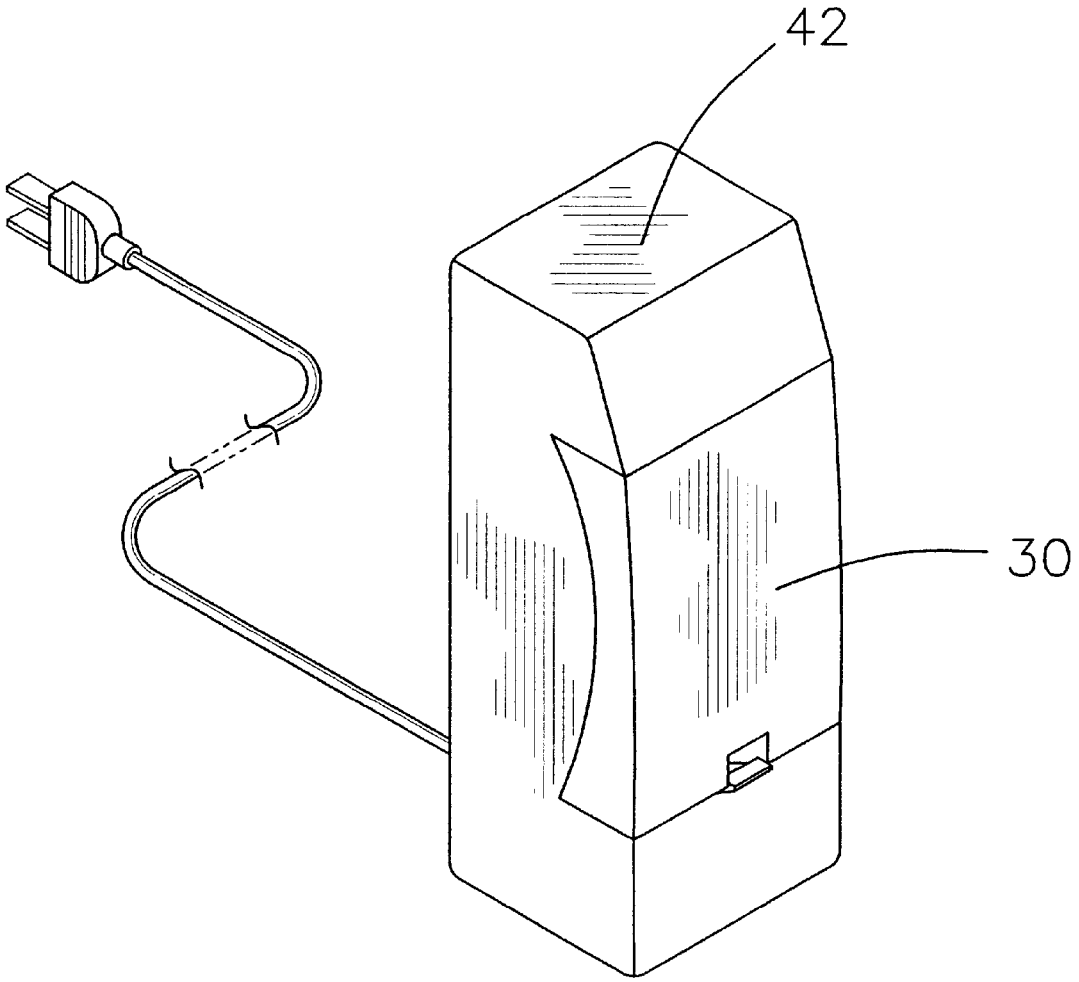
FIG. 4 is a perspective view of the present invention.
Figure 5:
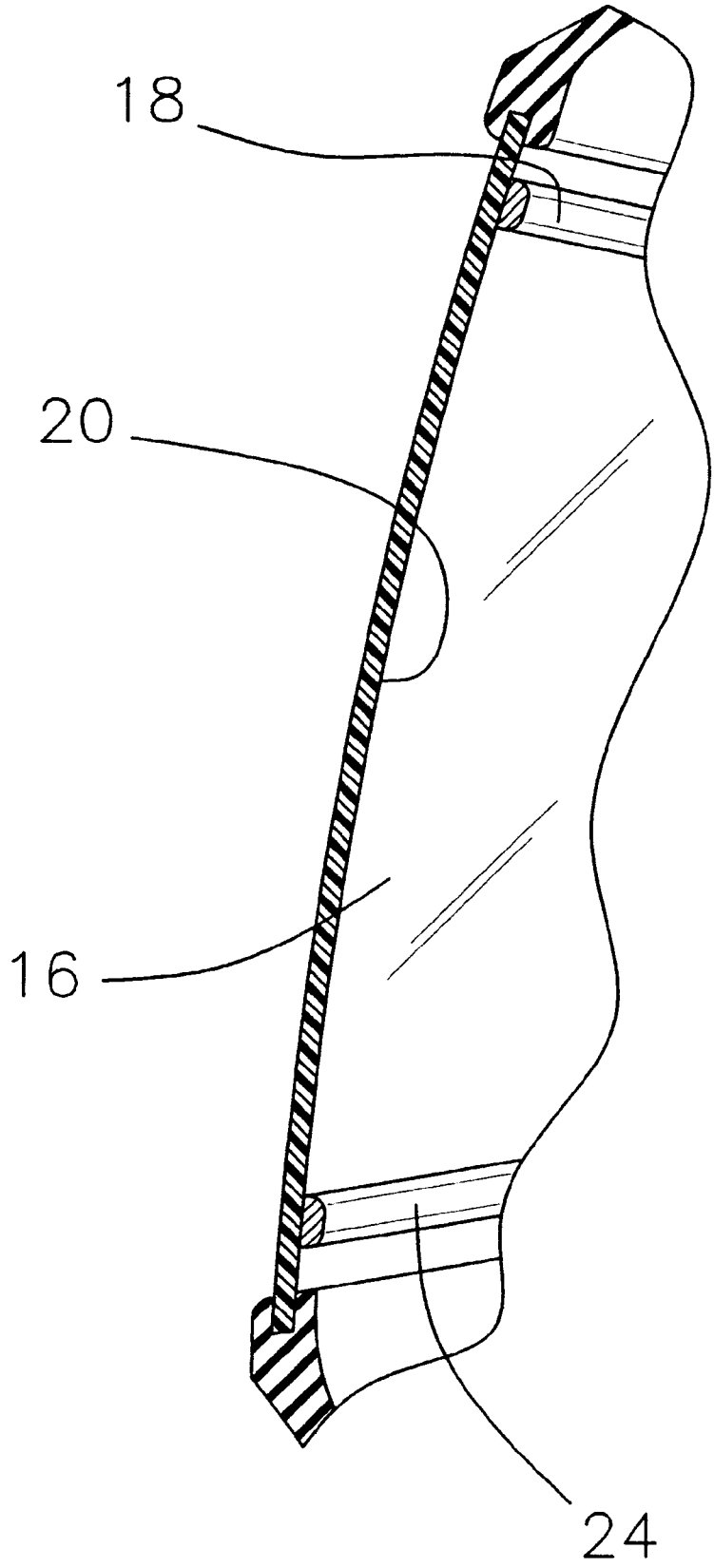
FIG. 5 is a cross-sectional view of the present invention.

With reference now to the drawings, and in particular to FIGS. 1 through 5 thereof, a new heated visor system embodying the principles and concepts of the present invention and generally designated by the reference numeral 10 will be described.

As best illustrated in FIGS. 1 through 5, the heated visor system 10 generally comprises a helmet 12 that has an opening 14. A means for coupling the helmet to a head of a user such that the opening is aligned with a face of the user. A substantially transparent visor 16 is coupled to the helmet 12 for covering the opening 14 such that the user can see through the visor 16.

A first heating element 18 is coupled to an interior face 20 of the visor 16 for heating the visor 16 to prevent fogging of the visor 16 during use of the helmet 12 in cold weather. The first heating element 18 is positioned to extend along a top edge 22 of the opening 14 when the visor 16 is positioned to cover the opening 14.

A second heating element 24 operationally coupled to the power source 26. The second heating element 24 is coupled to the interior face 20 of the visor 16 for preventing fogging of the visor 16 during use of the helmet 12 in cold weather. The second heating element 24 is positioned to extend along a lower edge 28 of the opening 14 when the visor 16 is positioned to cover the opening 14.

A pair of power sources 26 is for the first 18 and second 24 heating elements. Each of the power sources 26 is coupled to an associated side of the visor 16 such that the visor 16, first 18 and second 24 heating elements, and power sources 26 are removable from the helmet 12 each the power sources 26 including a respective battery 30. Each of the power sources 26 includes a respective battery housing 32 that has a connection port 34 in electrical communication with the respective battery 30. Each of the heating elements is couplable to each of the connection ports 34 whereby each the battery 30 provides power to each the heating elements.

The visor 16 includes a means for coupling 36 each the battery housing 32 to the visor. Each of the battery housing 32 includes a means for releasing 38 the battery housing 32 from the visor 16. Each of the power sources 26 has a respective on/off switch 40 coupled to the battery housing 32. The on/off switch 40 is operationally coupled between the battery 30 and the connection port 34 of each the power source 26 for permitting selective activation of the heating elements when each the battery housing 32 is coupled to the visor 16. A battery charger 42, each of the batteries 30 is operationally couplable to the battery charger 42 for recharging each the battery 30.

In use, the helmet would be applied and the visor heating system turned on. While riding, the visor would remain free of fogging and ice/snow accumulations so the rider can maintain the optimum view to the trail.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A heated visor system comprising:

a helmet having an opening;

a visor coupled to said helmet for covering said opening;

a heating element coupled to an interior face of said visor for heating said visor to prevent fogging of said visor during use of said helmet in cold weather;

a power source for said heating element, said power source being coupled to said visor whereby said visor, heating element, and power source are removable from said helmet; and said power source including a battery said power source including a battery housing having a connection port in electrical communication with said battery, said heating element being couplable to said connection port whereby said battery provides power to said heating element.

2. The heated visor system of claim 1, further comprising:

said heating element being a first heating element, said first heating element being positioned to extend along a top edge of said opening when said visor is positioned to cover said opening;

a second heating element operationally coupled to said power source, said second heating element being coupled to said interior surface of said visor, said second heating element being positioned to extend along a lower edge of said opening when said visor is positioned to cover said opening.

3. The heated visor system of claim 1, further comprising:

a battery charger, said battery being operationally couplable to said battery charger for recharging said battery.

4. The heated visor system of claim 1, further comprising:

said visor including means for coupling said battery housing to said visor; and said battery housing including means for releasing said battery housing from said visor.

5. The heated visor system of claim 1, further comprising:

an on/off switch coupled to said battery housing, said on/off switch being operationally coupled between said battery and said connection port for permitting selective activation of said heating elements when said battery housing is coupled to said visor.

6. A heated visor system comprising:

a helmet having an opening;

a means for coupling said helmet to a head of a user such that said opening is aligned with a face of the user;

a substantially transparent visor coupled to said helmet for covering said opening such that the user can sec through the visor;

a first heating element coupled to an interior face of said visor for heating said visor to prevent fogging of said visor during use of said helmet in cold weather, said first heating element being positioned to extend along a top edge of said opening when said visor is positioned to cover said opening;

a second heating element operationally coupled to said power source, said second heating element being coupled to said interior surface of said visor for preventing fogging of said visor during use of said helmet in cold weather, said second heating element being positioned to extend along a lower edge of said opening when said visor is positioned to cover said opening;

a pair of power sources for said first and second heating elements, each said power source being coupled to an associated side of said visor such that said visor, first and second heating elements, and power sources are removable from said helmet;

each said power source including a respective battery, each said power source including a respective battery housing having a connection port in electrical communication with said respective battery, each said heating element being couplable to each said connection port whereby each said battery provides power to each said heating element;

said visor including means for coupling each said battery housing to said visor;

each said battery housing including means for releasing said battery housing from said visor;

each said power source having a respective on/off switch coupled to said battery housing, said on/off switch being operationally coupled between said battery and said connection port of each said power source for permitting selective activation of said heating elements when each said battery housing is coupled to said visor; and a battery charger, each said battery being operationally couplable to said battery charger for recharging each said battery.

* * * * *